US008175313B2

(12) United States Patent
Piel et al.

(10) Patent No.: US 8,175,313 B2
(45) Date of Patent: May 8, 2012

(54) ELECTRONIC ANTI-SABOTAGE MICROPHONE GROMMET

(75) Inventors: Kevin G. Piel, Ronkonkoma, NY (US); Robert S. Adonailo, Rockville Centre, NY (US); Robert J. Orlando, Nesconset, NY (US)

(73) Assignee: Honeywell International Inc., Morristown, NJ (US)

( * ) Notice: Subject to any disclaimer, the term of this patent is extended or adjusted under 35 U.S.C. 154(b) by 1165 days.

(21) Appl. No.: 11/967,689

(22) Filed: Dec. 31, 2007

(65) Prior Publication Data

US 2009/0169042 A1 Jul. 2, 2009

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/00*** | (2006.01) |

(52) U.S. Cl. ..... 381/360; 381/355; 381/365

(58) Field of Classification Search ..... 381/355, 381/360, 365

See application file for complete search history.

(56) References Cited

U.S. PATENT DOCUMENTS

| | | | | |
|---|---|---|---|---|
| 3,579,220 | A | 5/1971 | Stevenson | |
| 4,241,335 | A | 12/1980 | Barnes | |
| 5,329,593 | A | 7/1994 | Lazzeroni et al. | |
| 6,201,876 | B1 | 3/2001 | Niemi et al. | |
| 2005/0265571 | A1 * | 12/2005 | Smith et al. | 381/355 |
| 2007/0262858 | A1 | 11/2007 | Smith | |

FOREIGN PATENT DOCUMENTS

WO WO 2005/120128 12/2005

OTHER PUBLICATIONS

European Search Report for companion EP Application No. 08 17 2365 dated Apr. 7, 2009 (5 pages).

* cited by examiner

*Primary Examiner* — Victor A Mandala
(74) *Attorney, Agent, or Firm* — Husch Blackwell

(57) ABSTRACT

A tamper detection apparatus includes a housing defining an internal cavity. A sensing device embodied as a microphone is positioned within the internal cavity of the housing, which may also be a protective grommet. A conductive element spans the internal cavity and is positioned in front of the microphone. The conductive element initiates a fault signal when a specified electrical condition is met to indicate a tampering or an attempted tampering with the microphone.

20 Claims, 2 Drawing Sheets

ELECTRONIC ANTI-SABOTAGE MICROPHONE GROMMET

BACKGROUND OF THE INVENTION

1. Field of Invention

The invention relates to the field of security sensing devices, and more specifically, a method and apparatus for detecting and deterring sabotage or tampering to critical areas and or components of security sensing devices.

2. Description of Related Art

In the field of apparatus for securing a premises, one measure of security is to provide a sensing device, or for example, a microphone for so-called "glassbreak" protection. It is known in the art, by both protectors and intruders, to monitor the glass portion of access portals, e.g., doors or windows, against breakage that may indicate an intrusion, as well as, frames of such access portals for motion. Therefore, security devices are known to detect whether an intruder attempts to enter a secured premises by breaking the glass of a window, or opening a window. Such attempts to intrude the premises, by breaking a window, door, or other violent breach, are typically noisy events. Therefore, it is known to provide a microphone or other sound detection for glassbreak monitoring. For example, such known devices are described in the co-owned and copending application U.S. Ser. No. 10/856,019 which is herein incorporated by reference in it's entirety.

It would therefore be advantageous to secure a sensing device or a glassbreak microphone against sabotage attempts, and/or to indicate that an attempt to sabotage the sensing device or microphone has taken place. Certain national and industrial standards in the field require at least such sabotage detection means.

SUMMARY OF THE INVENTION

In an aspect of the present invention, a tamper detection apparatus includes a housing defining an internal cavity, and a sensing device positioned within the internal cavity of the housing. A conductive element spans the internal cavity and is positioned in front of the sensing device, and the conductive element initiates a fault signal when a specified electrical condition is met. In another embodiment of the invention, the sensing device may be a microphone. Alternatively the housing may be a grommet. Further, the conductive element is electrically connected to a power source and a control device, and the conductive element initiates a remote fault signal at the control device. In one embodiment, the specified electrical condition includes an open circuit. In another embodiment, the specified electrical condition includes a closed circuit. Alternatively, the specified electrical condition is met when the conductive element is punctured. Further, the conductive element may be a membrane, include a conductive mesh material, or a conductive coating. The conductive element may be substantially transparent acoustically.

In another aspect of the present invention, a microphone grommet includes an enclosure having an internal cavity. The internal cavity is dimensioned to receive an input end of the microphone therein. A conductive element is integral with the enclosure spanning the internal cavity across the input end of the microphone, and the conductive element initiates a fault signal when a specified electrical condition is met. Further, the conductive element is electrically connected to a power source and may be connected to a control device, and the conductive element initiates a remote fault signal at the control device. In a related aspect, the enclosure comprises a plastic material and the plastic material may comprise neoprene. Additionally, the enclosure may include an acoustic cavity, and the acoustic cavity may extend from a first end of the enclosure to the conductive element.

In another aspect of the invention, a glassbreak detector includes a microphone and a protective grommet fitting over an input end of the microphone. The protective grommet comprises a grommet enclosure having an internal cavity and the internal cavity is dimensioned to receive the input end of the microphone therein. A conductive element is integral with the enclosure spanning the internal cavity across the input end of the microphone. The conductive element initiates a fault signal when a specified electrical condition is met. An outer enclosure surrounds the microphone and the protective grommet. In a related aspect, the outer enclosure has an opening to admit sound to the microphone. Further, a first acoustic cavity may extend from a first end of the grommet enclosure to the membrane.

BRIEF DESCRIPTION OF THE DRAWINGS

These and other objects, features and advantages of the present invention will become apparent from the following detailed description of illustrative embodiments thereof which is to be read in connection with the accompanying drawings, in which.

DETAILED DESCRIPTION OF THE INVENTION

Figure 1:
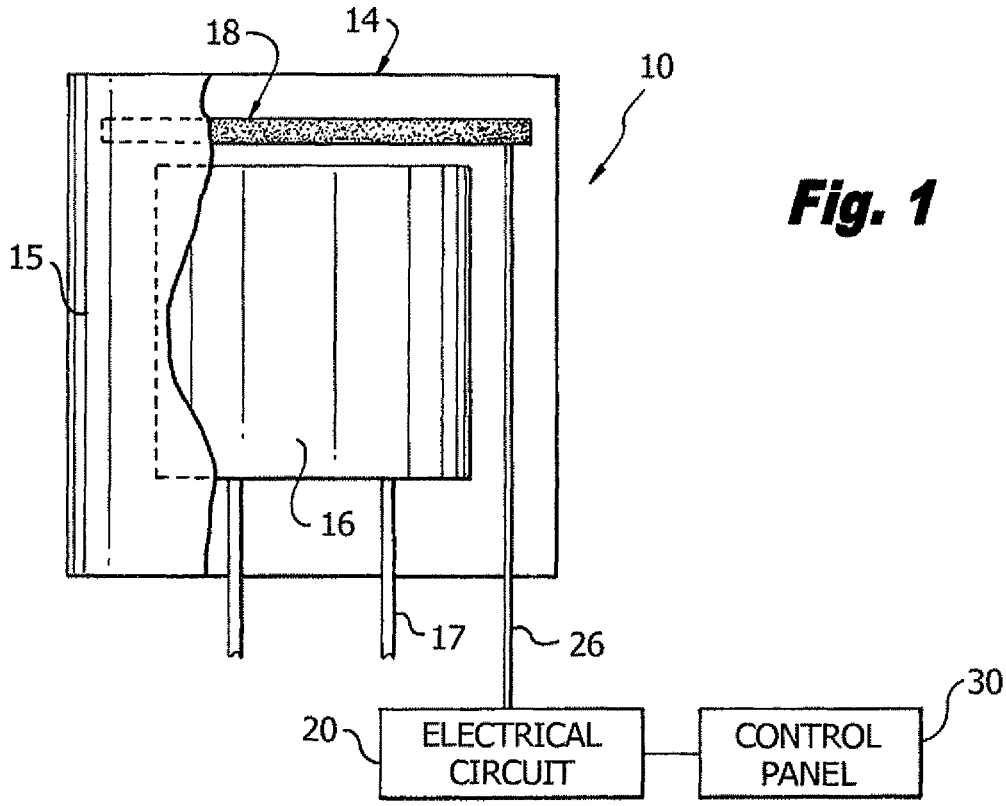
FIG. 1 is a cross-sectional side elevational view of a tamper detection apparatus according to the present invention including a conductive element embodied as a felt membrane across an input end of a electronic microphone enclosed in a housing.

An illustrative embodiment of a tamper detection apparatus 10 according to the present invention is shown in FIG. 1, and includes a housing 14 defining an internal cavity 15. The internal cavity 15 of the housing 14 encloses a sensing device embodied as a microphone 16 positioned within the internal cavity of the housing 14 using means known in the art. In an alternative embodiment, the housing may be a grommet or the like for further protecting the microphone. The microphone 16 may be connected to a power source (not shown) using lead lines 17. A conductive element embodied as a felt membrane 18 spans the internal cavity defined by the housing 14 and is substantially acoustically transparent. The felt membrane 18 is positioned in front of or across the input end of the microphone 16 and spans the internal cavity 15 of the housing 14 such that tampering or an attempt to tamper with the microphone 16 is not possible without engaging the felt membrane 18. The felt membrane 18 is electrically connected to a electrical circuit 20 via, for example, wired connectors 26 or wirelessly. The felt membrane 18 can thus transmit a signal via the electrical circuit 20, indicating possible tampering to the control panel 30 as shown in FIG. 1.

Figure 2:
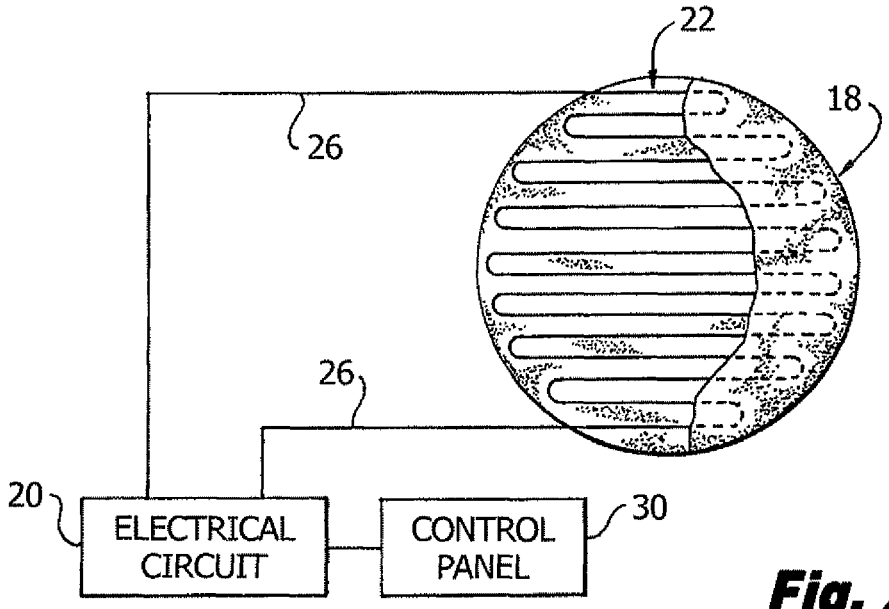
FIG. 2 is a cross-sectional plan view of the felt membrane shown in FIG. 1.

The felt membrane 18 includes a conductive weave embodied as copper wire mesh 22, as shown in FIG. 2, woven inside the felt membrane 18. Two lead wires extend from opposite ends of the copper wire 22 and are connected to the control panel 30. Alternatively, for example, other conductive elements may be used instead of the copper wire 22 such as any conductive wire or a conductive film or membrane, a conductive mesh material, or a conductive coating. Further, the felt membrane 18 may be replaced in alternative, for example, by plastic, mesh or other materials capable of embedding conductive elements therein.

The felt membrane 18 accommodating the copper wire 22 initiates a fault signal when a specified electrical condition is met by the copper wire 22 initiating the fault signal. In one embodiment, the specified electrical condition may include an open circuit wherein the copper wire 22 in the felt membrane 18 is broken, the electrical circuit 20 is terminated, thereby initiating a fault signal to the control panel 30. For example, in operation, the felt membrane 18 may itself be punctured or broken as the copper wire 22 is broken, or the membrane 18 may be tampered with such that it is not punctured, but the copper wire 22 is broken. In an alternative embodiment, the specified electrical condition may include a closed circuit wherein a circuit is completed when tampering occurs and initiates a fault signal to the control panel.

Figure 3:
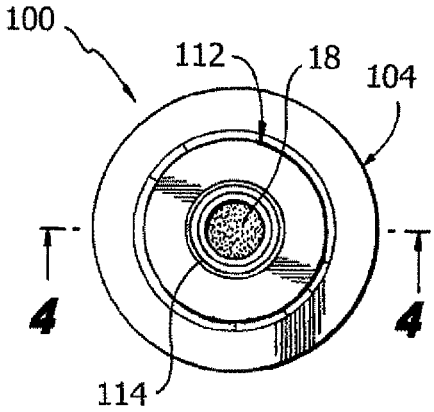
FIG. 3 is a plan view of a protective microphone grommet according to another embodiment of the present invention.
Figure 4:
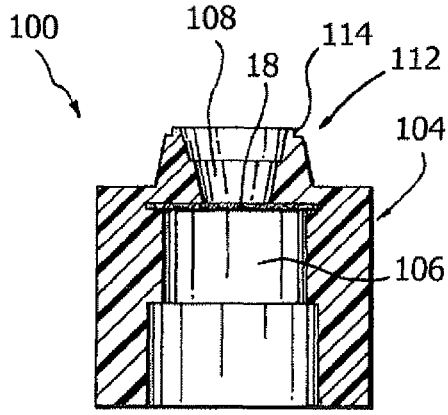
FIG. 4 is a cross-sectional side elevational view of the grommet taken along line A-A shown in FIG. 3.

Referring to FIGS. 3 and 4, in an alternative embodiment of a tamper detection apparatus 100, the housing 14 shown in FIG. 1, is replaced with a grommet 104 which defines first and second internal acoustic cavities 106, 108, respectively. The grommet 104 is generally cylindrical in shape, although other shapes are acceptable. The grommet 104 offers greater protection of the microphone 16 and the grommet may include plastic which may also comprise neoprene. The felt membrane 18 is utilized in the same manner as in the embodiment shown in FIG. 1. However, the felt membrane 16 and the grommet 104 define a first acoustic cavity 106 behind the membrane for housing the microphone (not shown in FIGS. 3 and 4), and a second acoustic cavity 108 in front of the input end of the microphone. A ridge 112 extends from the grommet 104 to form the second acoustic cavity 108 which aids in the performance of the microphone.

In the embodiment of the invention shown in FIGS. 3 and 4, the felt membrane 18 has a diameter that is larger than the of the second acoustic cavity 108 and is embedded into the grommet enclosure 104, particularly in an internal wall. The felt membrane 18 mesh 22 spans the internal cavity 106 and closes off the internal cavity 106 across the input end of the microphone.

Figure 5:
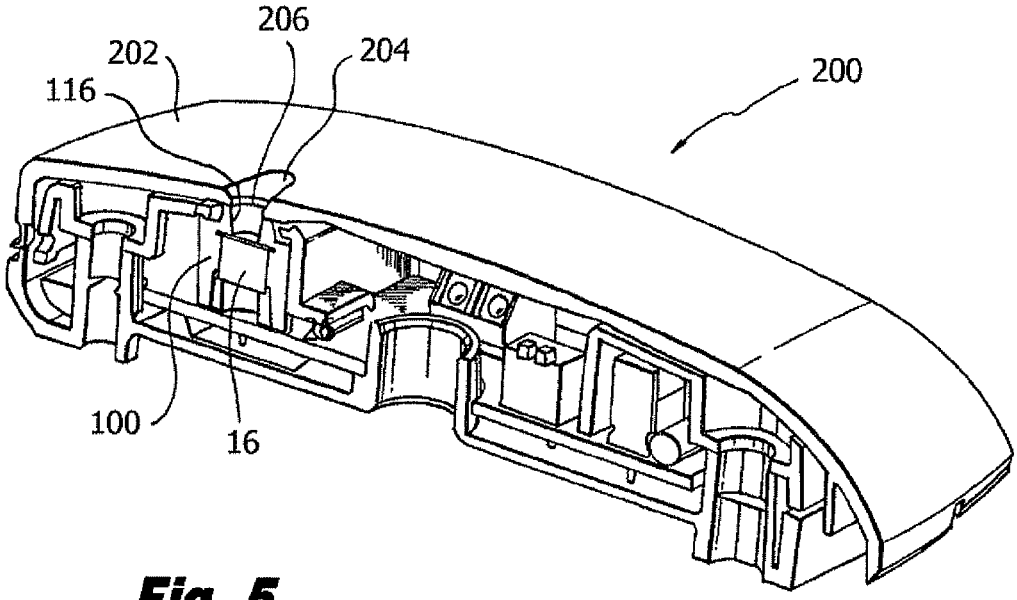
FIG. 5 is a perspective view of a glassbreak detector according to another embodiment of the present invention.

Referring now to FIG. 4, the grommet 100 also includes a lip 114 for accommodating a glassbreak detector interface 116. Referring to FIG. 5, according to another embodiment of the invention, a glassbreak detector 200 includes the microphone grommet 100. The glassbreak detector 200 includes an outer enclosure 202 and an acoustic cavity 204 leads to an opening 206, though which sound passes into acoustic cavity 108 of the grommet 100. The microphone 16 is positioned within the internal cavity 106 of the grommet 100. The second acoustic cavity 108 and the first acoustic cavity 106 of the grommet 100 cooperate to enhance the function of the microphone 16. As arranged, any attempts to physically sabotage the microphone at its input end via the second acoustic cavity 108 would necessarily break the felt membrane 18. Therefore, the tampering or attempted tampering would be indicated by the felt membrane 18 initiating a signal to the control panel and/or locally.

The present invention has been described herein with reference to certain exemplary and/or preferred embodiments. Certain modifications will be apparent to those skilled in the art, without departing from the scope of the invention. The embodiments described are offered merely as illustrative, and not limiting, on the scope of the present invention, which is defined with reference to the appended claims.

What is claimed is:

1. A tamper detection apparatus, comprising:

a housing defining an internal cavity;

a sensing device positioned within the internal cavity of the housing; and a conductive element spanning the internal cavity and positioned in front of the sensing device, wherein the conductive element transmits an electrical signal to indicate a tampering attempt.

2. The apparatus of claim 1, wherein the sensing device is a microphone.

3. The apparatus of claim 1, wherein the housing is a grommet.

4. The apparatus of claim 1, wherein the conductive element is electrically connected to a power source and a control device, and wherein the conductive element transmitting an electrical signal to indicate a tampering attempt includes the conductive element initiating a remote fault signal at the control device when a specified electrical condition is met.

5. The apparatus of claim 1, wherein the specified electrical condition includes an open circuit.

6. The apparatus of claim 1, wherein the specified electrical condition includes a closed circuit.

7. The apparatus of claim 1, wherein the specified electrical condition is met when the conductive element is punctured.

8. The apparatus of claim 1, wherein the conductive element is a membrane.

9. The apparatus of claim 1, wherein the conductive element includes a conductive mesh material.

10. The apparatus of claim 1, wherein the conductive element includes a conductive coating.

11. The apparatus of claim 1, wherein the conductive element is substantially transparent acoustically.

12. A microphone grommet, comprising:

an enclosure having an internal cavity, the internal cavity dimensioned to receive an input end of the microphone therein; and a conductive element integral with the enclosure spanning the internal cavity across the input end of the microphone, wherein the conductive element transmits an electrical signal to indicate a tampering attempt.

13. The microphone grommet of claim 12, wherein the conductive element is electrically connected to a power source and a control device, and wherein the conductive element transmitting an electrical signal to indicate a tampering attempt includes the conductive element initiating a remote fault signal at the control device when a specified electrical condition is met.

14. The microphone grommet of claim 12, wherein the enclosure comprises a plastic material.

15. The microphone grommet of claim 12, wherein the plastic material comprises neoprene.

16. The microphone grommet of claim 12, wherein the enclosure further comprises an acoustic cavity.

17. The microphone grommet of claim 12, wherein the acoustic cavity extends from a first end of the enclosure to the conductive element.

18. A glassbreak detector comprising:

a microphone;

a protective grommet fitting over an input end of the microphone, the protective grommet comprising:

a grommet enclosure having an internal cavity, the internal cavity dimensioned to receive the input end of the microphone therein;

a conductive element integral with the enclosure spanning the internal cavity across the input end of the microphone; and an outer enclosure surrounding the microphone and the protective grommet, wherein the conductive element transmits an electrical signal to a tampering attempt.

19. The glassbreak detector according to claim 18, wherein the outer enclosure has an opening to admit sound to the microphone.

20. The glassbreak detector according to claim 18, wherein the grommet enclosure further comprises a first acoustic cavity extending from a first end of the grommet enclosure to the conductive element.

* * * * *